US008511767B2

(12) United States Patent
Haidar et al.

(10) Patent No.: US 8,511,767 B2
(45) Date of Patent: Aug. 20, 2013

(54) MULTI-PIECE BASKET ASSEMBLY FOR A CONSUMER APPLIANCE

(75) Inventors: Omar Haidar, Prospect, KY (US); Bagawathkumar Chellappan, Louisville, KY (US); James Bryan Rawson, Crestwood, KY (US); Mukta Marwah, Hyderabad, IN (US); Jonathan Michael Cepress, Louisville, KY (US)

(73) Assignee: General Electric Company, Schenectady, NY (US)

( * ) Notice: Subject to any disclaimer, the term of this patent is extended or adjusted under 35 U.S.C. 154(b) by 336 days.

(21) Appl. No.: 12/961,766

(22) Filed: Dec. 7, 2010

(65) Prior Publication Data

US 2012/0139402 A1 Jun. 7, 2012

(51) Int. Cl.
*A47B 96/00* (2006.01)
*A47B 88/04* (2006.01)

(52) U.S. Cl.
USPC ..... 312/402; 312/348.2

(58) Field of Classification Search
USPC ..... 312/401, 402, 404, 405, 405.1, 330.1, 312/348.1, 348.2, 348.3; 220/4.21, 4.24, 220/4.31; 62/457.1, 382
See application file for complete search history.

(56) References Cited

U.S. PATENT DOCUMENTS

| | | | | |
|---|---|---|---|---|
| 2,711,944 | A * | 6/1955 | Meek et al. | 312/333 |
| 5,040,856 | A * | 8/1991 | Wilkins et al. | 312/402 |
| 5,366,284 | A | 11/1994 | Baker et al. | |
| 5,678,909 | A * | 10/1997 | Cheng et al. | 312/348.2 |
| 5,682,936 | A * | 11/1997 | Higdon, Jr. | 144/345 |
| 6,401,950 | B1 * | 6/2002 | Chiang | 220/1.5 |
| 6,915,947 | B2 * | 7/2005 | Siurek et al. | 229/101 |
| 6,991,307 | B2 * | 1/2006 | Hoenig | 312/348.3 |
| 2007/0204644 | A1 * | 9/2007 | Braun et al. | 62/344 |
| 2007/0262686 | A1 * | 11/2007 | Ji | 312/402 |
| 2009/0026906 | A1 * | 1/2009 | Kim | 312/401 |
| 2009/0045713 | A1 * | 2/2009 | Kunkle et al. | 312/402 |

* cited by examiner

*Primary Examiner* — James O Hansen
(74) *Attorney, Agent, or Firm* — Dority & Manning, P.A.

(57) ABSTRACT

A consumer appliance, such as a refrigerator, is provided with a compartment with a basket assembly, which may be configured on a pull-out drawer so as to move into and out of the compartment with the pull-out drawer. The basket assembly includes a first basket component and a second basket component releasably engaged with the first basket component along mating edges of the respective basket components, wherein in an engaged state, the first and second basket components define a singular continuous wall basket. At least one of the first or second basket components is releasable and removable from the pull-out drawer.

15 Claims, 3 Drawing Sheets

MULTI-PIECE BASKET ASSEMBLY FOR A CONSUMER APPLIANCE

FIELD OF THE INVENTION

The present subject matter relates generally to storage bins or baskets, and more particularly to a basket assembly for a consumer appliance, such as a refrigerator.

BACKGROUND OF THE INVENTION

Various styles of conventional refrigerators are designed with pull-out freezer drawers that include storage baskets or bins. Examples of these refrigerators include the Profile™ French door and Armoire style refrigerators from GE (General Electric) Appliances. For any number of reasons, including maintenance and cleaning, it is often necessary to remove the baskets from the drawer support structure, which can be a difficult and time-consuming task with many conventional designs. The baskets are generally large, particularly for the bottom drawer of a dual-drawer freezer compartment, and removal of the basket may require disassembly or removal of the entire drawer. Reducing the size of the baskets to make removal easier is not a desirable option.

Accordingly, it would be desirable to provide a basket assembly for a refrigerator that provides the consumer the ability to readily and easily remove the basket without sacrificing the usable volume of the basket.

BRIEF DESCRIPTION OF THE INVENTION

Aspects and advantages of the invention will be set forth in part in the following description, or may be obvious from the description, or may be learned through practice of the invention.

In an exemplary embodiment, a consumer appliance is provided with a compartment having a pull-out drawer. For example, the consumer appliance may be a refrigeration appliance with one or more pull-out drawers in the freezer or fresh-food compartments. A basket assembly is configured with the pull-out drawer so as to move into and out of the compartment with the pull-out drawer. The basket assembly may be attached to slide brackets that are mounted to a door panel of the pull-out drawer. The basket assembly includes a first basket component and a second basket component releasably engaged with the first basket component along mating edges of the respective basket components. In an engaged state, the first and second basket components define a singular continuous wall basket. At least one of the first or second basket components is releasable and removable from the pull-out drawer.

In a further embodiment, a basket assembly is provided for storage of items in a consumer appliance. The basket assembly includes a first basket component and a second basket component releasably engaged with the first basket component along respective mating edges of the basket components. In an engaged state, the first and second basket components define a singular continuous wall basket. The first basket component defines a front wall and partial side walls of the continuous wall basket, and the second basket component defines a back wall and partial side walls of the continuous wall basket. An interlocking engagement configuration is provided along the mating edges of the first and second basket components. In a particular embodiment, the basket assembly is configured for use in a pull-out drawer of a consumer appliance, such as a refrigeration appliance, and at least one of the basket components is configured for manual releasable attachment to support structure of the pull-out drawer, wherein the basket components are separable and one or both of the basket components are then readily removed from the support structure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
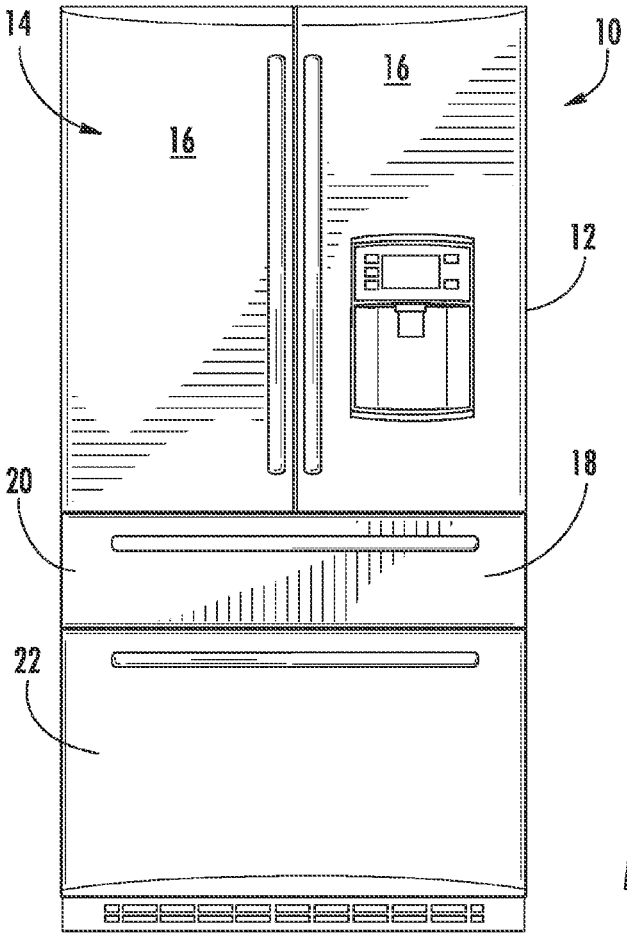
FIG. 1 is a perspective view of a consumer appliance, in particular a refrigerator, with a multiple or single drawer compartment.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts a consumer appliance 10 in a form of a refrigerator that may incorporate a basket assembly 26 (FIG. 2) in accordance with aspects of the invention. It should be appreciated that the term "consumer appliance" is used in a generic sense herein to encompass any manner of household appliance having an internal storage compartment that is accessible via a pull-out drawer. Conventional consumer appliances include, for example, refrigerators, freezers, ovens, washing machines, dryers, ranges, and so forth. For illustrative purposes, the present invention is described herein as a refrigerator embodiment of a consumer appliance 10. In this regard, the term "refrigerator" is also used in a generic sense herein to encompass any manner of refrigeration appliance, such as a freezer, refrigerator/freezer combination, and any style or model of conventional refrigerator. In the illustrated embodiment, the refrigerator 10 is depicted as an upright refrigerator having a cabinet or casing 12 that defines a number of internal storage compartments. In particular, the refrigerator 10 includes upper fresh-food compartments 14 having doors 16 and lower freezer compartment 18 having upper drawer 20 and lower drawer 22. The drawers 20, 22 are "pull-out" drawers in that they can be manually moved into and out of the freezer compartment 18 on suitable slide mechanisms, as depicted in FIG. 2.

Although described herein with reference to pull-out freezer compartment drawers, it should be appreciated that the basket assemblies 26 in accordance with aspects of the invention are not limited in this manner and may have utility with drawers in the fresh-food compartment 14, or in any other compartment of a consumer appliance (with or without attachment to a pull-out drawer).

Figure 2:
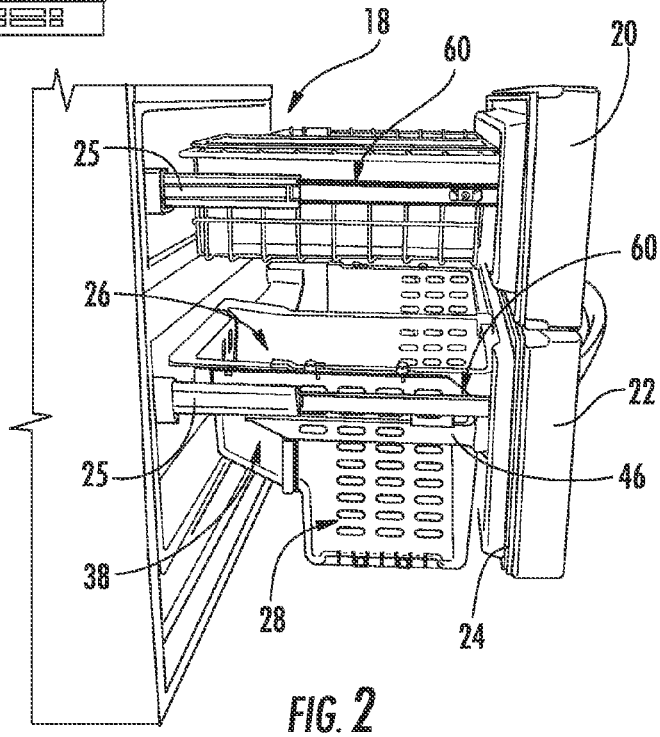
FIG. 2 is a side perspective view of the freezer drawers of the refrigerator of FIG. 1 pulled out of the freezer compartment.
Figure 3:
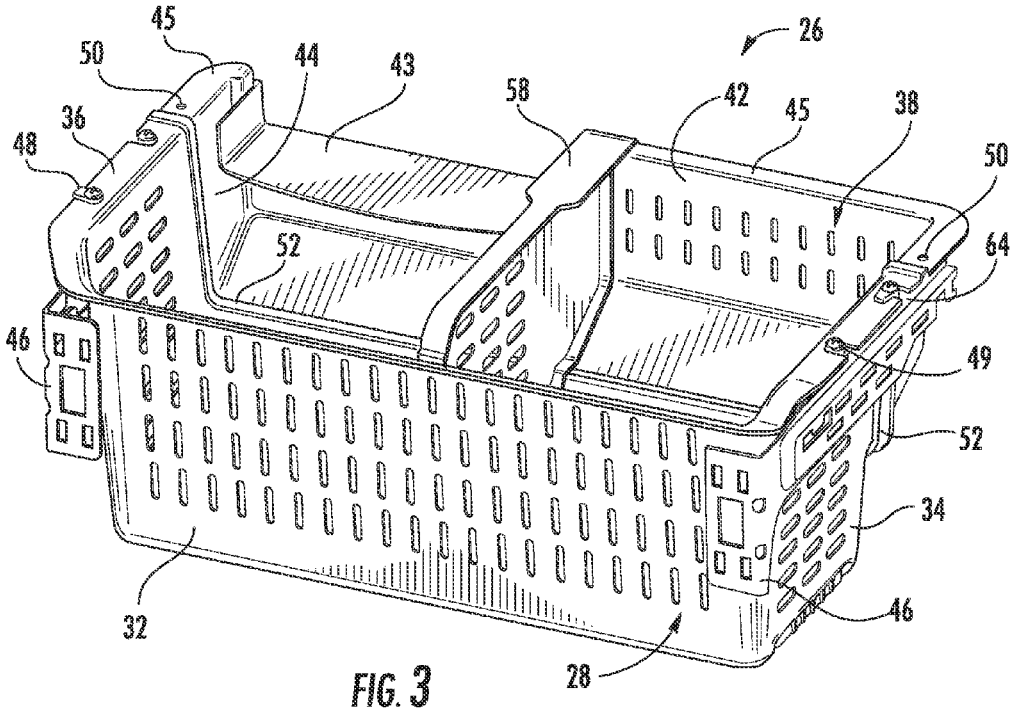
FIG. 3 is a perspective view of an embodiment of a basket assembly for use in a pull-out refrigerator drawer.
Figure 4:
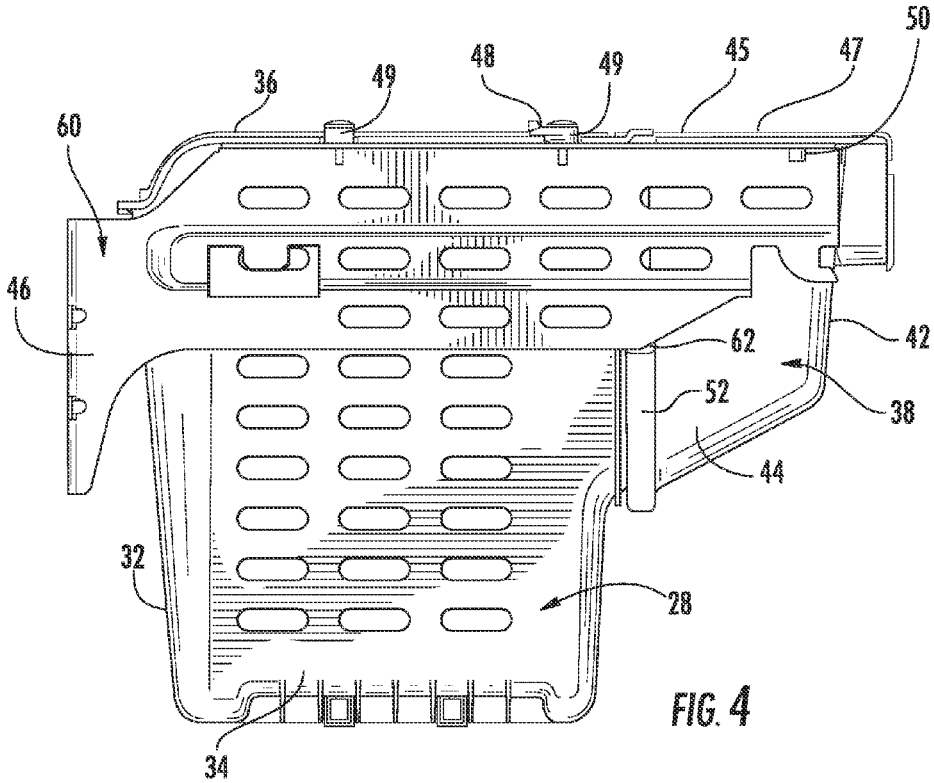
FIG. 4 is a side view of the basket assembly of FIG. 3.
Figure 5:
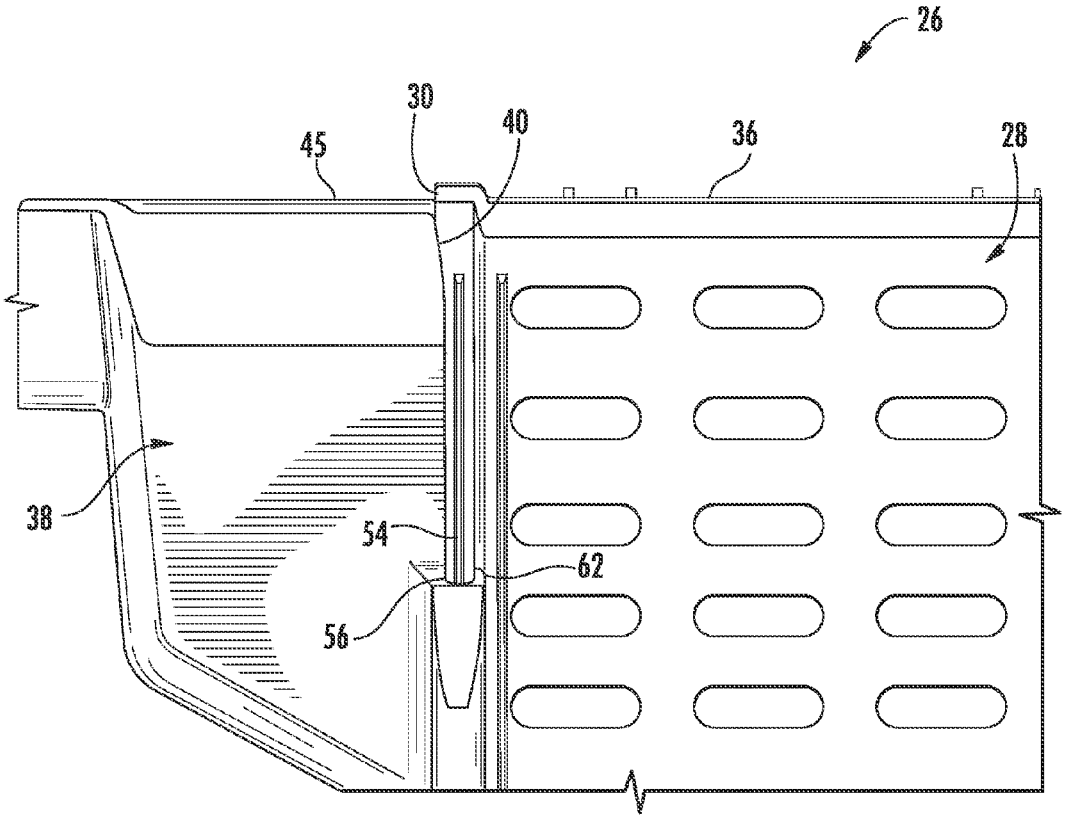
FIG. 5 is a partial side view of the basket assembly of FIG. 4 without attached slide brackets.

FIG. 2 depicts the freezer compartment 18 or the refrigerator 10 with the upper drawer 18 and the lower drawer 22 pulled out of the compartment. Each of the drawers 18, 22 include "baskets" for the storage of food items. It should be appreciated that the term "basket" is used herein to encompass any manner of storage bin, box, pan, container, or the like, wherein a consumer can readily place or remove items in/from the internal compartment of the refrigerator 10 (or other consumer appliance). The baskets are supported on any manner of support structure 60 configured with the drawer panels, including slide mechanism as described in greater detail below. The bottom drawer 22 utilizes a basket assembly 26 in accordance with aspects of the invention. The basket assembly 26 includes a first basket component 28 and a second basket component 38. The basket components 28, 38 are releasably engaged with each other along mating edges 30, 40 (FIG. 5) along an engagement line 52 (FIG. 4). As can be particularly appreciated from FIG. 3, in the engaged state, the basket components 28, 38 define a singular basket having a continuous circumferential wall. In other words, the basket has a front wall, side walls, and a back wall that define the circumference of the basket, and the basket components 28, 38 combine to forms these walls. In the illustrated embodiment, the first basket component 28 defines the front wall 32 and includes partial side walls 34. The second basket component 38 includes the back wall 42 and partial side walls 44.

At least one of the basket components 28, 38 is readily releasable and removable from the drawer 22 without disassembly of the drawer or removal of the other basket component. In the illustrated embodiment, the first basket component 28, which is the forward component with respect to the drawer 22, is removable by a user manually releasing locking devices 48 that secure the basket component 28 to the support structure 60 (or to the other basket component 38). Upon release of the locking mechanisms 48, the first basket component 28 can be separated from the second basket component 38 along the engagement line 52 and removed from the drawer 22. It should be appreciated that the second basket component 38 may be the removable component, with the first basket component 28 remaining attached to the support structure 60. Alternatively, both basket components 28, 38 may be manually releasable and removable from support structure. It should also be understood that manual release of one basket component 28, 38 may release the other component from the support structure. For example, manual release of the first basket component 28 from the support structure 60 via the locking mechanisms 48 and removal of the basket component 28 may also result in the second basket component being "unlocked" and readily removed from the support structure 60.

In the illustrated embodiment, the basket components 22, 38 are supported on each of their opposite sides by slide brackets 46. The slide brackets 46 are, in turn, attached to the back or interior side of a door panel 24 associated with the drawer 22. The slide brackets 46 are operably engaged with a member of a conventional slide mechanism 25. It should be appreciated that the construction of the slide brackets 46 can vary widely within the scope and spirit of the invention. The slide brackets 46 may be formed from single or multiple components and all such constructions are encompassed within the term "slide bracket." The basket assembly 26 essentially spans the width of the freezer compartment 18 and the slide brackets 46 are attached to the panel 24 at generally the opposite sides thereof. Thus, in this manner, the basket assembly 26 moves into and out of the freezer compartment 18 upon movement of the door panel 24 towards and away from the refrigerator 10 on the slide mechanisms 25. Referring to FIGS. 3 and 4 in particular, the second basket component 38 includes an upper lip 45 that rests on an upper flange surface 47 of the slide bracket 46. Any manner of alignment structure, such as projections 50, may be used to locate the upper lip 45 on the flange 47. The projections 50 may simply extend through holes in the upper lip 45 so that the second basket component 38 is also readily removable from the support structure 60 (i.e., the slide brackets 46). Alternatively, the alignment structure may be dispensed with entirely and the upper lip 45 may simply rest on the flange 47. In still an alternative embodiment, the alignment structure may be in the form of a "permanent" fastener, for example, a rivet, screw, weld, or the like.

The first basket component 28 includes a lip 36 that also overlies the flange 47 on the slide bracket 46, and may also overlie a portion of the lip 45 of the second basket component 38. Any manner of suitable releasable locking mechanism 48 secures the lip 36 relative to the flange 47. Desirably, the locking mechanism 48 is manually operated and does not require the use of a tool or other external item. In the illustrated embodiment, the releasable locking mechanism 48 is depicted as a finger-operated lever that moves into and out of engagement with the lip 36. The lip 36 may include a recess or cut-out 64 that engages around a post 49 that is configured with the locking mechanism 48, with the lever rotating on the post 49. This recess and post arrangement allows for relatively easy removal and insertion of the basket component 28 on the slide brackets 46.

It should be appreciated that any manner of releasable locking mechanism 48 may be used within the scope and spirit of the invention. For example, a detent mechanism may suffice to align and secure the first basket component 28 relative to the slide bracket 46 (and/or second basket component 38). Likewise, a snap-fit connection, bayonet connection, hook-and-loop connection, manually releasable mechanical connection such as a wing nut on a threaded post, and so forth may be used in this regard. It should also be appreciated that the use of a key, tool, or other device to release the locking mechanism 38 is within the scope and spirit of the invention.

The engagement line 52 between the first basket component 28 and second basket component 38 may be formed by any manner of interlocking engagement structure. For example, any manner of male/female structure may be utilized. In the illustrated embodiment, a rib 54 defined around the edge 30 of the first basket component 28 engages in a groove 56 defined around at last a portion of the edge 40 of the second basket component 38. The groove 56 may be defined in a protruding rim that terminates in an edge surface 62. Referring to FIG. 4, this edge 62 engages against a bottom edge of the slide bracket 46 and thus further serves to align and secure the second basket component 38 relative to the slide bracket 46.

The basket assembly 26 may include any manner of additional structure. For example, a divider wall 58 is illustrated in the figures for separating the basket assembly 26 into left and right sections. Any other manner of dividing structure, shelves, covers, and so forth may be included with the basket assembly 26. FIG. 3 illustrates a guide 43 for an ice bucket (not illustrated). This guide 43 serves as a resting location for an ice bucket, and also provides a natural load line for the basket assembly 26.

It should also be appreciated that the basket components 28, 38 are not limited to any particular shape, material, or style. In the embodiment depicted in the figures, the basket components 28, 38, are molded plastic components having an opened cellular structure for increased air flow through the baskets. The basket components 28, 38 could also be formed as an open-weave wire configuration, and so forth.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A consumer appliance, comprising:

a compartment with a pull-out drawer;

slide brackets attached to said pull-out drawer;

a basket assembly configured with said pull-out drawer so as to move into and out of said compartment with said pull-out drawer;

said basket assembly comprising a first basket component and a second basket component, said first and second basket components each spanning between and attached to said slide brackets, said second basket component releasably engaged with said first basket component along mating edges of said first and second basket components, said first basket component defining a rib and said second basket component defining a groove at the mating edges of said first and second basket components, the rib of said first basket component engaging the groove of said second basket component in order to couple said first and second basket components to each other, wherein in an engaged state said first and second basket components define a singular continuous wall basket; and at least one of said first or second basket components being releasable and removable from said pull-out drawer, said releasable and removable basket component selectively mounted to at least one of said slide brackets with a manually releasable locking mechanism, the manually releasable locking mechanism mounted to the at least one of said slide brackets and selectively engaging said releasable and removable basket component in order to selectively mount said releasable removable basket component to the at least one of said slide brackets.

2. The appliance as in claim 1, wherein said first basket component is said releasable and removable basket component and is forward of said second basket component and adjacent a door panel of said pull-out drawer.

3. The appliance as in claim 2, wherein said second basket component is releasable and removable from said pull-out drawer after removal of said first basket component.

4. The appliance as in claim 1, wherein said first and second basket components span the length of said pull-out drawer, said first basket component being the releasable and removable basket component and disposed adjacent a door panel of said pull-out drawer, said first basket component integrally defining a front wall and partial side walls of said singular continuous wall basket, and said second basket component integrally defining a back wall and partial side walls of said singular continuous wall basket.

5. The appliance as in claim 4, further comprising a removable divider wall spanning between said front wall and said back wall.

6. The appliance as in claim 1, wherein said appliance is a refrigerator having one or more pull-out drawers in a freezer compartment, said basket assembly configured with one or more of said pull-out drawers.

7. The appliance as in claim 1, wherein said manually releasable locking mechanism comprises a post mounted to the at least one of said slide brackets and a lever rotatably mounted to said post, the lever of said manually releasable locking mechanism selectively engaging said releasable and removable basket component in order to selectively mount said releasable removable basket component to the at least one of said slide brackets.

8. The appliance as in claim 7, wherein said first basket component comprises a top lip, the top lip of said first basket component defining a recess for receiving the post of said manually releasable locking mechanism, the lever of said manually releasable locking mechanism selectively engaging the top lip of said first basket component in order to secure said first basket component to the at least one of said slide brackets.

9. The appliance as in claim 1, further comprising a projection mounted to the at least one of said slide brackets, said second basket component comprising a top lip, the top lip of said second basket component defining a hole, said projection received within the hole of the top lip of said second basket component in order to position said second basket component on the at least one of said slide brackets.

10. The appliance as in claim 1, wherein said first and second basket components have a width so as to span a width of the compartment.

11. The appliance as in claim 1, wherein said first basket component comprises a top lip and said second basket component comprises a top lip, the top lip of said first basket component positioned on said slide brackets in order to support said first basket component on said slide brackets, the top lip of said second basket component positioned on said slide brackets in order to support said second basket component on said slide brackets.

12. The appliance as in claim 11, wherein the top lip of said first basket component overlies the top lip of said second basket component at the mating edges of said first and second basket components.

13. The appliance as in claim 1, wherein the groove of said second basket component terminates at an edge surface, the edge surface of said second basket component contacting a bottom edge of the at least one of said slide brackets.

14. The appliance as in claim 13, wherein the edge surface of said second basket component aligns said second basket component relative to the at least one of said slide brackets.

15. The appliance as in claim 1, further comprising fasteners, said fasteners mounting said second basket component to the at least one of said slide brackets.

* * * * *

UNITED STATES PATENT AND TRADEMARK OFFICE

CERTIFICATE OF CORRECTION

PATENT NO. : 8,511,767 B2
APPLICATION NO. : 12/961766
DATED : August 20, 2013
INVENTOR(S) : Omar Haidar et al.

It is certified that error appears in the above-identified patent and that said Letters Patent is hereby corrected as shown below:

Title page item [75], Column 1, Inventors: currently reads..."Mukta Marwah, Hyderabad, IN (US)..." should read --...Mukta Marwah, Hyderabad (IN)...--

Signed and Sealed this
Fourth Day of March, 2014

Michelle K. Lee

Michelle K. Lee
*Deputy Director of the United States Patent and Trademark Office*